United States Patent [19]

Liu

[11] Patent Number: 4,509,761

[45] Date of Patent: Apr. 9, 1985

[54] MODEL SHUTTLECOCK

[76] Inventor: Mau-Fan Liu, No. 28, Alley 2, La. 141, Tung-Ho St., Taipei, Taiwan

[21] Appl. No.: 509,149

[22] Filed: Jun. 29, 1983

[51] Int. Cl.[3] ..... A63B 67/18

[52] U.S. Cl. ..... 273/417

[58] Field of Search ..... 273/417; D21/207

[56] References Cited

U.S. PATENT DOCUMENTS

| | | | |
|---|---|---|---|
| 2,860,879 | 11/1958 | Carlton | 273/417 |
| 3,100,116 | 8/1963 | Fagan et al. | 273/417 |
| 3,313,543 | 4/1967 | Carlton | 273/417 |
| 3,359,002 | 12/1967 | Wolf | 273/417 |
| 3,831,943 | 8/1974 | Popplewell | 273/417 |
| 3,904,205 | 9/1975 | Robinson | 273/417 |

FOREIGN PATENT DOCUMENTS

| | | | |
|---|---|---|---|
| 17487 | 10/1980 | European Pat. Off. | 273/417 |
| 996695 | 6/1965 | United Kingdom | 273/417 |
| 1413515 | 11/1975 | United Kingdom | 273/417 |
| 1505470 | 3/1978 | United Kingdom | 273/417 |
| 2088227 | 6/1982 | United Kingdom | 273/417 |

*Primary Examiner*—Paul E. Shapiro

*Attorney, Agent, or Firm*—Armstrong, Nikaido, Marmelstein & Kubovcik

[57] ABSTRACT

This invention relates to a new model plastic shuttlecock which composed of a round tail skirt without undulation and a mid-skirt zone with some reinforcing circles and stems of pyramidal section, which offers appropriate strength of its tail skirt. And there are two rows of air resistant surfaces which are extended from the end of the tail skirt towards the mid-skirt zone and the inner side of the feather wings. The air exhaust surfaces have many larger net shaped air stream outlets to make the shuttlecock rotate and balance the air pressure difference between the inner and outer sides of the feather wings increasing the accuracy and stability of stroke and flight of the shuttlecock and also preventing its swinging to and fro during flight.

5 Claims, 8 Drawing Figures

MODEL SHUTTLECOCK

BACKGROUNG OF THE INVENTION

Generally shuttlecocks can be classified into two kinds, i.e., feather shuttlecocks and plastic shuttlecocks. Plastic shuttlecocks have been used for more than 15 years, and their quality improved in controlling the flight speed, stability and the feeling of stroke etc.; they became popular because of their high reliability. However, there are still some defects on the traditional design which can not appropriately meet the flight requirements. In playing badminton, the requirements for shuttlecock flight are as follows:

1. The maximum counter-stroke speed should be maintained between 75 Km/hr–77 Km/hr.
2. At the end of flight parabola, i.e., flight power being equal to zero, a shuttlecock should drop down as vertical as possible.
3. A shuttlecock should not swing to and fro during its flight.

In the past, plastic shuttlecocks have offered the design of lower skirt undulation which had two different ratios of surfaces formed by the undulation, and also offered the effect of rotation during the flight. The design of tail skirt undulation has been prevailing among the plastic shuttlecocks giving them increasing flight stability, and also offering the necessary means for preventing them from swinging to and fro during flight. However, the lower skirt of a plastic moulded shuttlecock, which is handicapped by the weight distribution and the tail skirt undulation being supported by the very thin stems, used to be deformed and shrunk by air pressure when it was hit by a racket. Then the projection area of the lower skirt was decreased, and the radius of counter-rotation (owing to the air resistant area being decreased) was increased. Thus, the problems of accuracy of stroke, stability of counter-stroke and control should be improved accordingly. Furthermore, the design of the air resistant area of the lower skirt undulation have not permitted improvement of the exhaust air stream by opening larger air stream outlets therein owing to its weak structure. However, the difference of air sucking pressure between inner and outer sides of the lower skirt can not be lowered, and thus improved flight stability of a shuttlecock can not be obtained.

To sum up the facts mentioned above, conventional shuttlecocks can not fulfill all the requirements for flight stability owing to their faulty shape and the arrangement of their lower skirt undulation with its poor reinforcement and its air stream exhaust ocurring both on the air exhaust and air resistant surfaces. In consideration of the facts mentioned above, the inventor offers an improved design for his new model shuttlecock which has a strong lower skirt with reinforced stems arranged on both its air exhaust and air resistant surfaces in order to improve flight stability. Thus, the main object of this invention is the provision of a new design for both the air exhaust and air resistant surfaces at the end of the lower skirt feather wings to form a round, undulation and which reinforces the lower skirt with reinforcing circles and stems of pyramidal section. Also, these two rows of air exhaust and air resistant surfaces are extended from the end of the lower skirt into the mid-skirt zone and the inner side of the feather wings; the air exhaust surfaces are dotted with many larger air stream outlets therein in order to balance the air pressure differential between the inner and outer sides of the feather wings. Owing to the reinforcement of the lower skirt structure and the reduced air resistance preventing its deformation when hit by a racket, the shuttlecock can also provide reduced radius of counterstroke and increased accuracy of stroke.

The angle of intersection between air exhaust and air resistant surfaces and the arrangement of air stream outlets not only reduces the effect of vacuum towing on the shuttlecock and increases its rotation effect but also prevents it from swinging to and fro during flight.

SUMMARY OF THE INVENTION

This invention relates to a new shuttlecock in which the lower tail skirt is newly designed, with respect to its feather wing undulation and arrangement, thus increasing the rigidity and air resistance of the tail skirt and improving the rotating flight characteristics of the shuttlecock in the air. Thus, this new design can improve performance and meet with all the requirements for flight stability and parabola as well as for speed control.

DETAILED DESCRIPTION OF THE INVENTION

Figure 1:
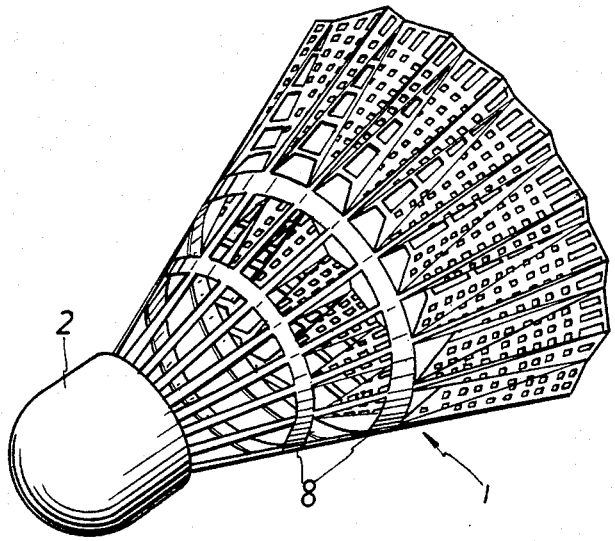
FIG. 1 is the perspective view of the invention.
Figure 2:
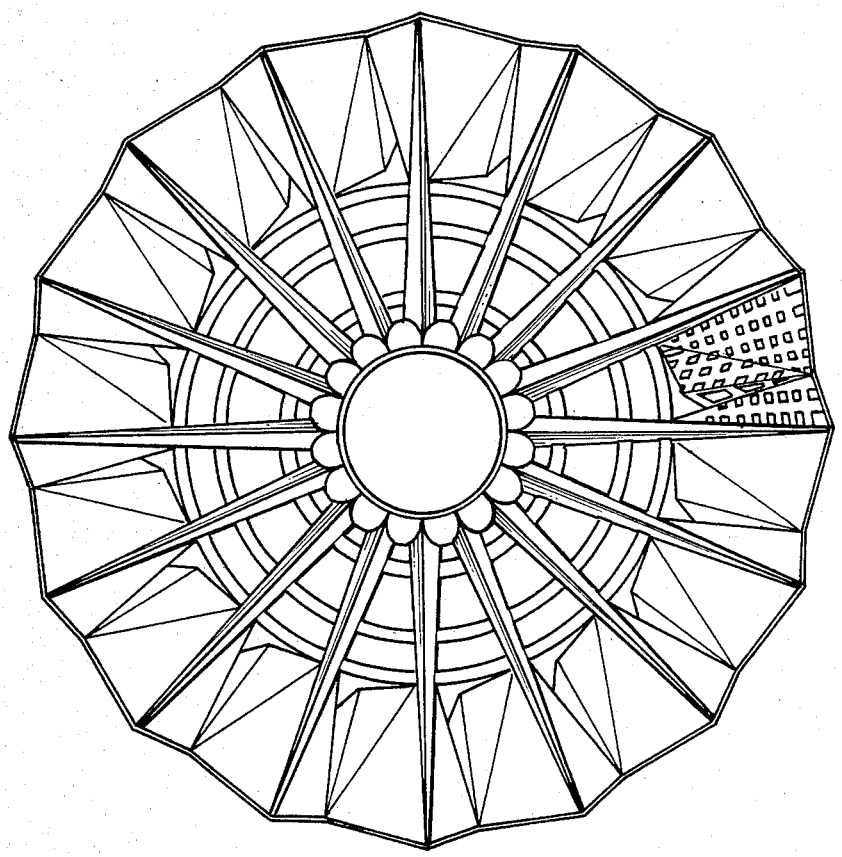
FIG. 2 is the plan view of the lower skirt of the invention.
Figure 3:
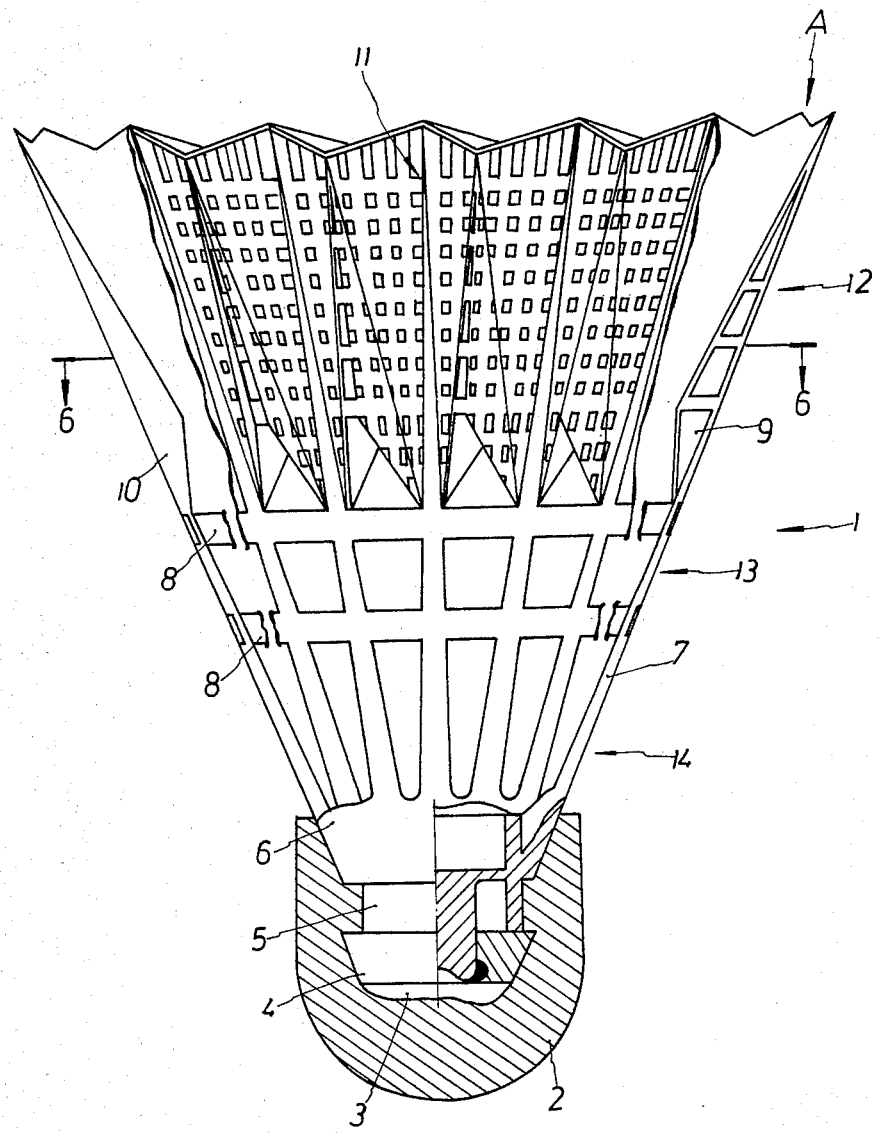
FIG. 3 is the sectional view of the parts of this invention.
Figure 4:
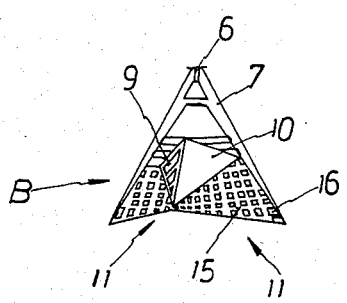
FIG. 4 is a view of both air exhaust and air resistant surfaces on a single feather wing from point A on FIG. 3.
Figure 5:
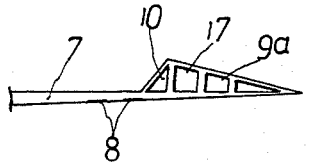
FIG. 5 is a view of an air exhaust surface from point B on FIG. 4.

Referring to the drawings, this invention consists of a body 1 and a hemispheric cork 2. The hemispheric cork is made with cork or foamed plastic materials (i.e., foamed PVC). A hollow 3 inside the hemispheric cork is coupled with the shaft ring 4 of the body 1. Beside the hemispheric cork 2, the body 1 is made with plastic materials (nylon or polyethylene) as by monobloc moulding. The body 1 comprises a collar 5, a shaft ring 4, a base seat 6, stems 7, reinforcing circles 8, air exhaust surfaces 9, air resistant surfaces 10 and skirt feather wings 11. Stems 7 are extended from the base seat 6 outwardly to constitute a conical tail skirt of the shuttlecock. The sectional shape of stems 7 is pyramidal, and their thickness is gradually decreased from base seat 6 to the end of the lower skirt. The conical tail skirt of the body 1 can be classified into 3 portions: the upper skirt zone 14 which is adjacent to the base seat 6; the wider lower skirt zone 12 which is located in the end of the body 1; and the mid-skirt zone 13 which is located between the other two portions.

The upper skirt zone 14 comprises stems 7 which extend outwardly from the base seat 6.

The mid-skirt zone 13 comprises two or more reinforcing circles 8 spaced at intervals, which are connected to the adjoining stems 7 in order to give appropriate support to the body 1.

Figure 6:
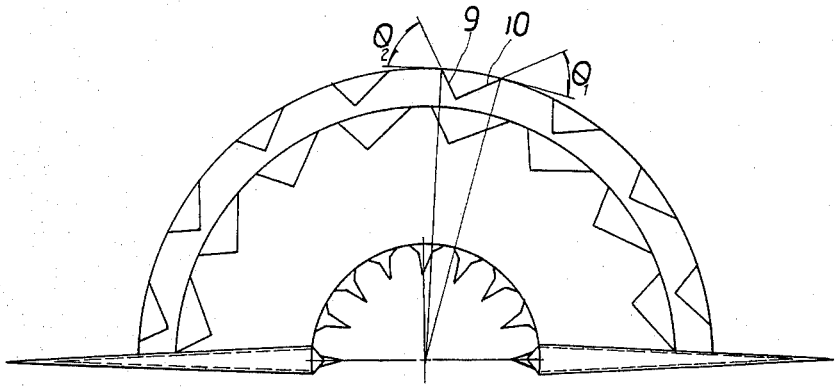
FIG. 6 is a sectional view along line 6—6 of FIG. 3.
Figure 8:
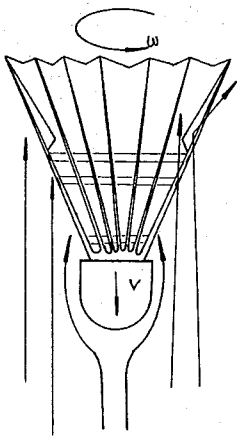
FIG. 8 is a representation of the rotation of a shuttlecock in the flight.

The lower skirt zone 12 is composed of feather wings 11 which are located on each stem as an unit. The air exhaust surfaces 9 are located between two adjoining feather wings 11 and the air resistant surface 10. Each feather wing 11 is a net-like structure consisting of a series of ribs, extending parallelly to both sides from the stems 7, and strands 16 which extend parallel to the stems 7. The air resistant and air exhaust surfaces are angularly connected to one another, and they are also connected laterally to the feather wings 11. The air resistant surfaces extend from a point one third of the distance from the end of the lower skirt and also from the middle of two adjacent stems towards the reinforcing circles 8 and the inner side of the body 1, and from a 30° angle of tangent $\theta_1$ with the adjoining feather wing 11 as shown in FIG. 6. The angularly connected air exhaust surfaces 9 form about a 60° angle of tangent $\theta_2$ with the adjoining feather wing 11, the projected line along the crest line 17 of the angularly connected surfaces being aimed near the central axis of the base seat 6. The air resistant surfaces 10 can be plain or of net-like shape with dotted holes therein, whereas the air exhaust surfaces 9 may have a comparatively large area with many more stream outlets, which can be determined as an appropriate ratio of its area to that of the former to attain the best rotation speed according to a particular situation. The sectional shape of stems 7 is pyramidal, and has a double triangular section which has a larger combined sectional coefficient and greater resistance to bending stress. As to the weight distribution of a shuttlecock, this can be controlled by changing the depth of two combined triangular passages for fluid plastic materials when moulding the stems.

This invention has been designed following the example illustrated, when air resistant and air exhaust surfaces are extended from the end of lower skirt toward the mid-skirt zone to form a larger air resistant zone (i.e., a larger air resistance area) in order to reduce air resistant pressure on the lower skirt, and also without undulation thereon, by the several circles of ribs 15. When a shuttlecock is hit by a racket, the hardened lower skirt feather wings and the air exhaust and air resistant surfaces can efficiently take hold of the air, and make a sharp and bursting sound to improve the feeling of the stroke.

Figure 7:
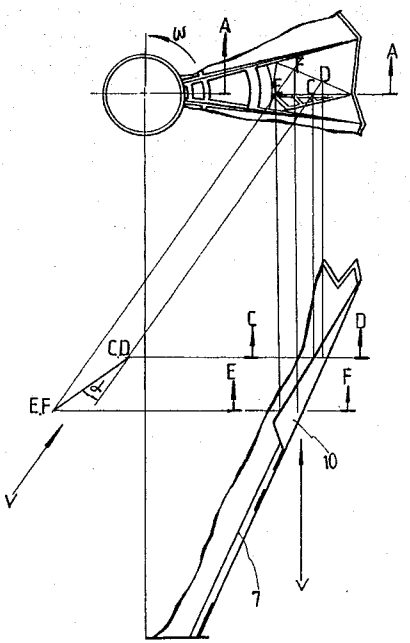
FIG. 7 is a projection view showing the angle of attack between the air resistant surface and air stream line.

FIG. 7 is a projection view of the air resistant surfaces 10 against air stream line V and an angle of attack $\alpha$.

In conventional plastic shuttlecocks, the angle of intersection between both sides of the tail skirt is fixed at 45° with some deviations for flight speed requirements under some specific circumstances. Generally, some deviations on the angle can be arranged, but for the sake of the external appearance, too large or small a change in the intersection angle of the shuttlecock tail skirt will be hardly acceptable. However, the air resistant surfaces in this invention can offer an advanced design for better function for flight speed without any change in the tail skirt intersection angle. In this invention, the air resistant surfaces can increase or decrease the angle of attack $\alpha$, and change a certain range in the angle of tangent $\theta_1$. According to many years' experience involved in shuttlecock manufacturing, the air resistant surfaces should have a larger angle of attack from the mid-skirt zone to the end of the lower skirt, to obtain a maximum efficiency of the angle of attack. The air resistant surfaces can be increased in area by means of two or more complex surfaces extending toward the end of tail skirt without using wave-like undulation on the tail for increasing the air resistant area.

In the invention, the portions of the mid-skirt zone 13 and the upper skirt zone 14 are full of air stream outlets except for the reinforcing circles 8 and the stems 7. These air outlets can decrease the vortex effect at the edge of the shuttlecock tail skirt in flight. And the air resistant surfaces having an angle of attack can resolve vector of the air resistance force in to kinetic energy for rotation, and inertia, decrease the vortex effect on the tail skirt, and also avoid the swinging to and fro of the shuttlecock flight. As for stability in flight, speed control and fixing of the shuttlecock's flight parabola, these can be obtained by the inertia of the shuttlecock rotation and a maximum vortex effect.

I claim:

1. A plastic shuttlecock comprising a hemispheric cork and a body of monobloc molded plastic materials; said body being composed of a shaft ring, a collar, a base seat and stems, which stems extend outwardly from the base seat to form a conical structure; and a tail skirt composed of three portions: an upper skirt connected to the base seat; a lower skirt comprising feather wings extending from opposite sides of the stems and having air exhaust surfaces and air resistant surfaces, said air exhaust surfaces and air resistant surfaces being angularly connected to each other at one edge and to said feathers, forming an outwardly open V-shape recessed relative to the surface of the tail skirt; and a mid-skirt comprising a plurality of reinforcing circles connected with said stems.

2. A shuttlecock as claimed in claim 1 wherein the feather wings further comprise parallel horizontal ribs extending to both sides from the stems and vertically extending strands.

3. A shuttlecock as claimed in either one of claims 1 or 2, wherein the air resistant and air exhaust surfaces extend from a point one third of the distance from the end of the tail skirt to the mid-skirt; the air resistant surfaces being angled about 30° relative to the feather wings and the air exhaust surfaces being angled about 60° relative to the feather wings; the crest line of the angularly connected air resistant and air exhaust surfaces being aimed near to the central axis of the shuttlecock; the air exhaust surfaces having larger air stream outlets than the air resistant surfaces and being smaller in area than the air resistant surfaces.

4. A shuttlecock claimed in claim 1, wherein the mid-skirt zone of the body is composed of several reinforcing circles which are connected with the stems in equal intervals and at least one of the circles is connected to the lower skirt feather wings and also to one edge of the air resistant surfaces to improve the strength of the tail skirt structure.

5. A shuttlecock claimed in claim 1, wherein the cross-section of the stems is of pyramidal shape, such that the weight distribution of the shuttlecock body can be controlled by varying the two combined triangular sections of the stems.

* * * * *